United States Patent [19]

Faust

[11] 4,098,502

[45] Jul. 4, 1978

[54] MULTI PURPOSE EXERCISE BENCH

[76] Inventor: Reginald O. Faust, 41 Oak Ct., Annapolis, Md. 21401

[21] Appl. No.: 797,634

[22] Filed: May 17, 1977

[51] Int. Cl.[2] ..... A63B 23/00

[52] U.S. Cl. ..... 272/144; 272/109; 272/117

[58] Field of Search ..... 272/117, 118, 109, 134, 272/138, 144, 145; 128/25 R; 297/377, 411; 5/60, 66–69, 77, 120

[56] References Cited

U.S. PATENT DOCUMENTS

| | | | |
|---|---|---|---|
| 2,817,522 | 12/1957 | Margulies | 272/144 |
| 2,831,687 | 4/1958 | Hunter | 272/145 |
| 2,855,199 | 10/1958 | Noland et al. | 272/117 |
| 3,120,954 | 2/1964 | Apostol | 272/117 |
| 3,207,512 | 9/1965 | Kinsey | 272/118 X |
| 3,342,485 | 9/1967 | Gaul | 272/145 |
| 3,501,140 | 3/1970 | Eichorn | 272/144 X |
| 3,708,166 | 1/1973 | Annas | 272/118 X |
| 3,817,243 | 6/1974 | Perrine | 272/145 X |

OTHER PUBLICATIONS

"Strength and Health"; Oct.-Nov. 1974; p. 63.

*Primary Examiner*—Richard J. Apley
*Attorney, Agent, or Firm*—Scrivener, Parker, Scrivener and Clarke

[57] ABSTRACT

The invention is a multi-purpose exercise bench that can be readily converted to any one of eight different uses quickly and without the use of tools. The bench of the invention eliminates the expense and required space for a variety of different units heretofore necessary for performing all of the exercises which can be accomplished on the single bench of the invention.

11 Claims, 8 Drawing Figures

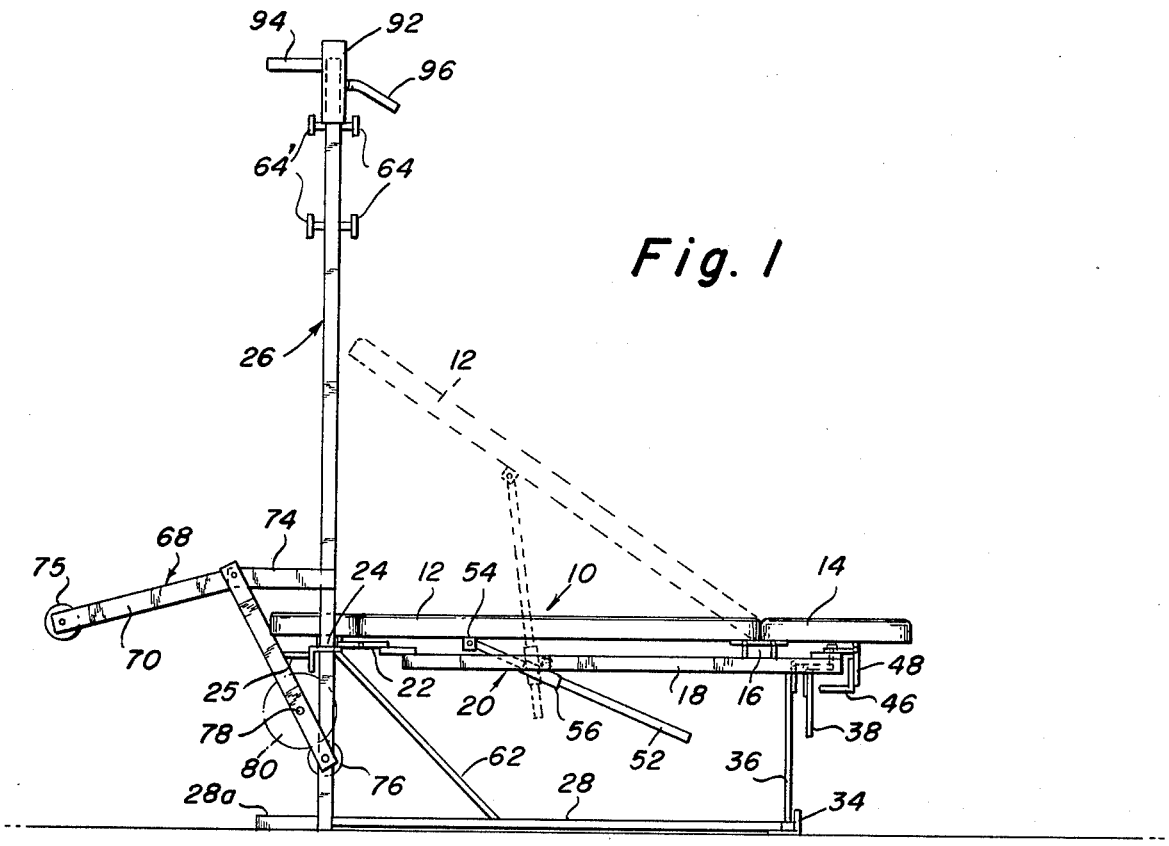
Fig. 1
Fig. 3
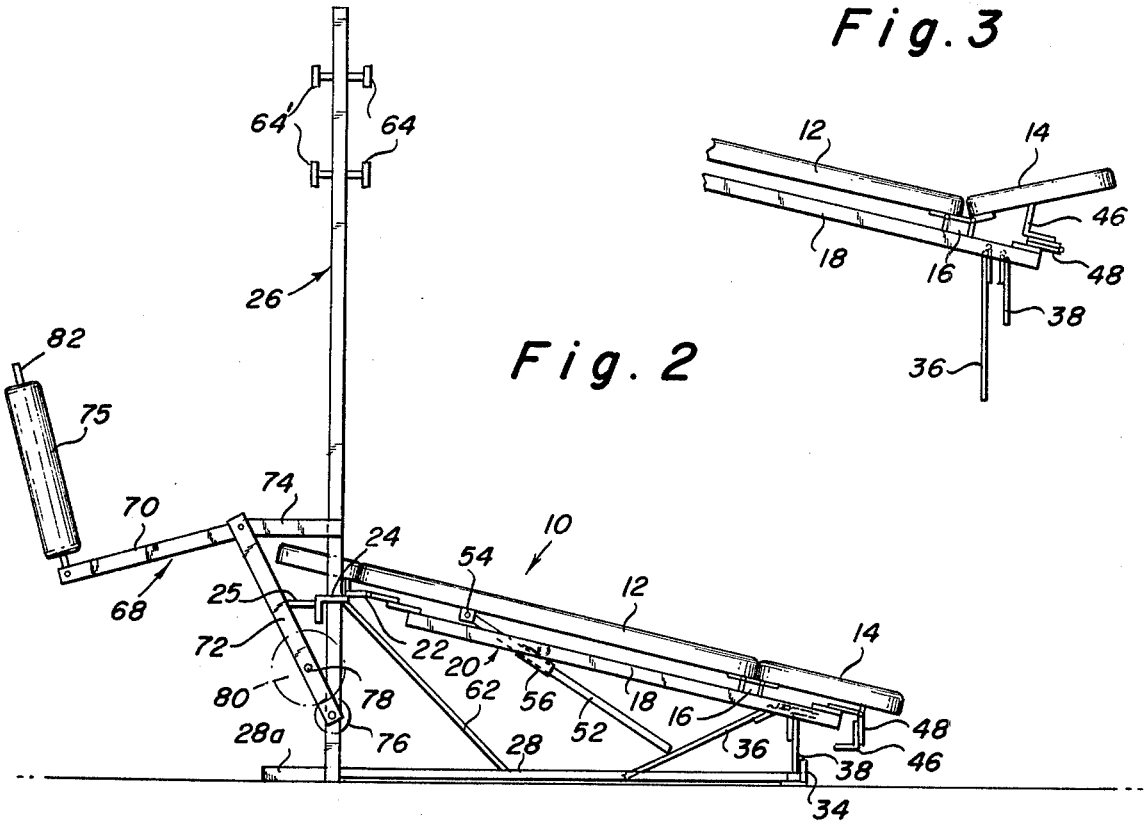
Fig. 2

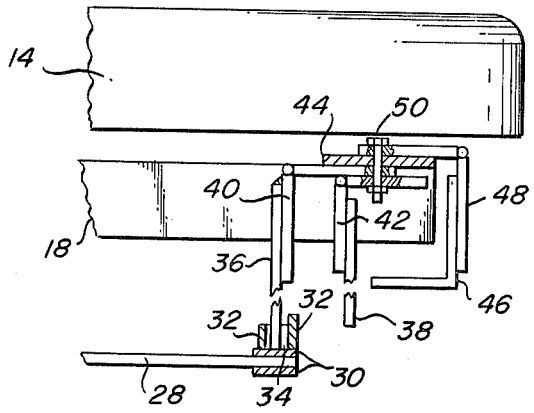
Fig. 4
Fig. 5
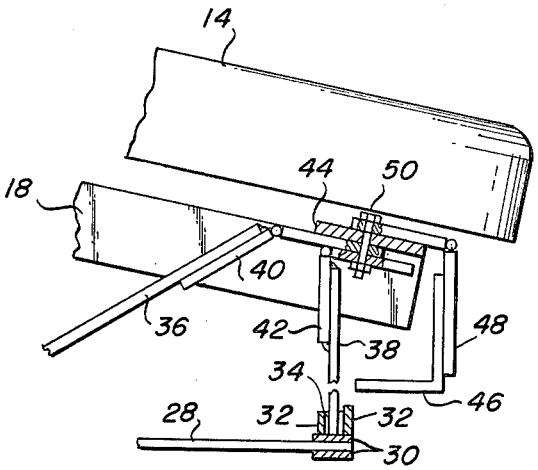
Fig. 6
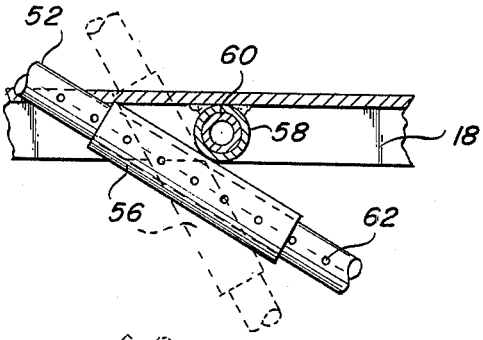
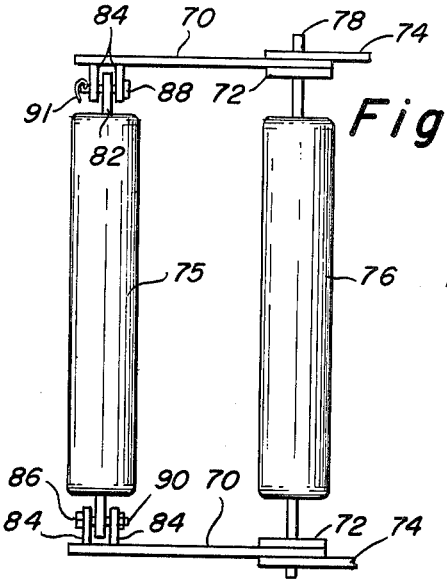
Fig. 7
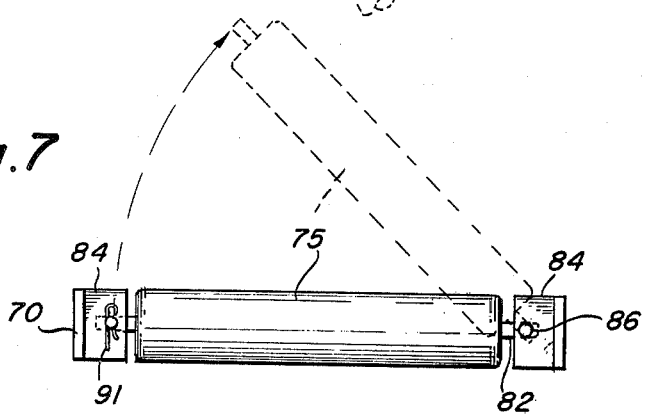
Fig. 8

MULTI PURPOSE EXERCISE BENCH

This invention relates to exercise benches and more particularly to an improved multi-purpose or combination bench wherein a variety of exercises can be performed by the use of a single, adjustable bench.

Heretofore exercises for body or muscle building have required the use of several different types of benches and related components in order for the exerciser to work on strengthening all of his body muscles. These several units have generally comprised a sit-up board, a flat bench, an inclined bench, leg extension rollers, a declined bench, a deep-knee bench, a bench press, and means for dips. Heretofore, a few of these units have been combined in a single bench, for example, a flat bench can have a part movable from a flat position to an inclined position thus combining in one unit flat and inclined benches; or a flat bench can include leg extension rollers or a bench press, but until the present invention there has never been a body building bench which has incorporated all of the standard exercising units enumerated above.

It is the broad object of this invention to provide a multipurpose exercise bench which embraces all of the standard exercising units in a single assembly.

More particularly, it is an object of the invention to provide a multi-purpose exercising bench which can be easily converted from one use to another in a minimum of time with minimum effort and without the need for tools of any kind.

Other objects and their attendant advantages will become apparent as the following detailed description is read in conjunction with the accompanying drawings wherein;

FIG. 1 is a side elevational view of the multipurpose bench of the invention showing it in its flat position and in dotted lines, in its inclined position;

FIG. 2 is a view similar to FIG. 1 but showing the bench in its declined position;

FIG. 3 is a broken and partial view showing a small seat portion of the bench in an angular adjusted position;

FIG. 4 is a broken, enlarged detailed view showing the leg arrangement for supporting the bench in a flat position;

FIG. 5 is a view similar to FIG. 4 but showing the leg arrangement for adjusting the bench to its declined position;

FIG. 6 is a broken enlarged detailed view showing means for adjusting the seat to an inclined position;

FIG. 7 is a top plan view of leg extension rollers of the invention; and

FIG. 8 is a front elevational view of a leg extension roller embracing features of the invention.

Referring now to the drawings, and particularly FIGS. 1 and 2, the numeral 10 refers to a padded bench part of the bench assembly composed of a first elongated front portion 12 and a second short, rear seat portion 14, the adjacent ends of the portions 12, 14 being hinged to a cross member 16 connected, such as by welding or the like, between side members 18 of a movable frame 20 which is pivotally connected by a hinge 22 to a cross member 24 of a vertical frame, generally indicated by the numeral 26. The cross member 24 has welded to its front side, a forwardly extending, U-shaped handle 25 which is grasped by an exerciser lying on the bench and doing leg lifts.

The lower end of the vertical frame 26 is rigidly connected to the front end of a base frame 28 whose rear end is sandwiched between pairs of transverse members 30 (FIG. 4) defining the rear part of the base frame 28. Welded to the transverse members 30 intermediate the ends thereof are vertical wall members 32 defining a socket 34 adapted to receive the lower ends of one or the other of a pair of legs 36,38 whose upper ends are connected by hinges 40, 42, respectively, to the lower side of a transverse frame 44 defining the rear end of the moveable frame member 18.

With particular reference to FIGS. 1 and 2, it will be noted that the leg 36 is substantially longer than the leg 38 and when the former is received within the socket 34, the moveable frame 20 and hence the padded bench 10 are supported in a flat or horizontal position. It is a simple matter to lift the bench about its front hinge 22 to disengage the leg 36 from the socket 34 and then lower the rear end of the bench until the lower end of the shorter leg 38 can be engaged within the socket 34 whereupon the bench is supported by the leg 38 in the declined position of FIG. 2. When in this position, the longer leg 36 is merely swung forwardly so that it rests on the ground as can be clearly seen in FIG. 2.

As previously mentioned, the short seat portion of the bench is hinged for movement to an angular or inclined position relative to the longer main part of the padded bench. The purpose of the seat part is to prevent an exerciser from sliding off the bench while doing incline exercises. The seat portion may be selectively retained in its inclined position in any of a variety of ways, one such means being, as shown, by the use of a section of angle iron 46 which is connected, as by welding, to one flap of a hinge 48 whose other flap is fastened to the upper side of the transverse member 44. Conveniently, common fastener means such as bolts and nuts 50 can extend through all three fixed flaps of the hinges 40, 42 and 48 to connect the hinges to the cross member 44.

As can be seen in FIG. 3, after the seat part 14 has been manually raised, the angle iron is merely flipped over so that its free leg or flange is substantially vertical for supporting the seat portion in its angled or raised position.

The elongated portion 12 of the bench is retained in any one of a series of selected inclined positions by means of a strut 52 which is hinged at its upper end to a suitable bracket 54 carried by the underside of the elongated portion of the padded bench. The strut is slideable in a sleeve 56 which is welded to a second sleeve 58 rotatably received on a transverse spindle 60 fastened at its ends to the side parts 18 of the moveable frame 20. The strut is provided with a series of holes 62 adapted to receive a pin engagable with the upper edge of the sleeve 56 to retain the strut and hence the bench part 12 in any one of a series of selected elevated positions so as to adjust the degree of incline of the bench portion 12.

The vertical frame 26 is rigidified by a strut 62 extending between the frame 26 and the base frame 28. The upper part of the frame 26 carries headed members 64, 64', adapted to receive the bar of a bar bell with the headed members 64 on the rear side of the frame being for bar bells utilised in bench pressing wherein the exerciser lies on his back on the bench and lifts the bar bell from a pair of headed members 64 and after exercising returns the bar to the headed members. Without such members for receiving the bar bell before and after exercising, the exerciser must have an assistant to help him with a heavy bar bell or other wise he could be subjected to grave danger from the weight, as those experienced in this field are well aware.

The headed members 64' on the front side of the frame 26 have the same purpose as the member 64 except that they are utilised for supporting a bar bell which is to be received on the shoulder of an exerciser who backs up to the frame 26 and lifts the bar bell to his shoulders for the purpose of doing deep knee bends. After exercising, the bar bell is returned to the headed members 64', there being as many sets of the members 64, 64' vertically spaced as necessary to accomodate the users of varying height and arm length.

An important feature of the present invention is the leg extension roller assembly generally indicated by the numeral 68. Leg extension roller assemblies are known in themselves and comprise two pairs of angularly related rocker arms 70, 72 the arms of each pair being rigidly connected together at one end with this end being pivoted to the front end of the bench forwardly thereof as by hinge pins at the forward ends of horizontal arms 74 whose rear ends are rigidly fixed, as by welding, to the upright members of the vertical frame 26. The arms are pivotally supported so that one pair of arms 70 extends generally forwardly and the other pair 72 extends generally downwardly.

The outer end of the pairs of arms 70,72 each carries a padded roller 75, 76 respectively, arranged that the upper roller 75 may be engaged by the feet of an exerciser lying on his back on the bench. The lower roller 76 is positioned to be engaged by the feet of an exerciser sitting on the end of the bench. Each of the downwardly extending arms 72 is provided with a lateral projection 78 adapted to receive circular weights such as the one shown in phantom lines at 80 in FIG. 1, whereby the exerciser's legs can be subjected to increasing resistance from the weights as he exercises.

Heretofore, the leg extension assembly has been a unitary structure with there being no reason to render the assembly easily demountable since, prior to the present invention, the leg extension assembly has not been used in conjunction with the same bench which is utilised for bench presses and for deep knee bends. As stated, for deep knee bends, the exerciser must be able to back into the vertical frame to receive the bar bell supported on the headed members 64' on his shoulders. However, even if the combination of leg extension rollers and a vertical frame did exist, it would have been a time consuming chore for the exerciser to remove bodily the leg extension assembly in order to utilize the deep knee bend feature of the bench. In accordance with the invention, instead of having to bodily remove the leg extender assembly the upper roller 74 is supported on a coaxial rod 82 whose ends project between pairs of bracket arms 84 rigidly fixed to the inner faces of the upper rocker arms 70. The ends of the rod 82 and the bracket arms 84 have alinged openings for the reception of headed fastener elements 86,88 one of which may be threaded to receive a nut 90 and the other of which may be drilled to receive a quick disconnect cotter pin 91 which, upon removal, enables the roller 75 to be readily swung about the other pin from its horizontal working position to a raised position as shown in FIGS. 2 and 8, where the roller is entirely clear of the path to the vertical frame should the exerciser wish to use it for lifting weights for deep knee bends.

Instead of deep knee bends, the exerciser may wish to use the outer side of the vertical frame for body dips. For this use, a pair of removeable sleeves 92 shown in FIG. 1 are provided to slide over the free upper ends of the side parts of the vertical frame. Each sleeve has welded or otherwise rigidly fixed to it a handle 94 and each sleeve also carries a clamping screw 96 whereby the sleeves 92 can be rigidly clamped in position. As shown, the upper headed members 64, 66 can serve as stop means for positioning the members 92. In use, an exerciser, grasps the handles 94 and raises and lowers his body for arm and shoulder exercises.

It is believed that the use of the bench of the invention should be clear from the foregoing detailed description.

It will be apparent that the bench of the invention is easily and rapidly converted to any one of at least 8 exercising units which heretofore have required a number of separate units placing an exercising assembly outside of the economic range of the ordinary user. It will be apparent that the invention is susceptible to a variety of changes and modifications without, however, departing from the scope and spirit of the appendant claims.

What is claimed is:

1. A multi-purpose exercising bench comprising a fixed horizontal ground engaging frame having front and rear ends, a vertical frame rigidly fixed to the front end of said horizontal frame, a moveable frame having front and rear ends, means pivoting the front end of said moveable frame to said vertical frame at a position spaced above said horizontal frame, a padded bench having a front and rear ends carried by the upper side of said moveable frame, a plurality of differene length legs pivotally connected at one end to the under side of said moveable frame adjacent the rear end thereof, socket means carried by said fixed frame adjacent the rear end thereof and adapted to receive therein the respective opposite ends of selected ones of said different length legs for adjusting the decline position of said moveable frame and said bench, one of said legs having a length supporting said moveable frame in a flat or horizontal position.

2. The bench of claim 1 including means pivotally connectingg said padded bench adjacent its rear end to said moveable frame, and means extending between said padded bench and said moveable frame for releasably retaining said padded bench in selected inclined positions relative to said moveable frame.

3. The bench of claim 2 including a padded seat portion pivotally connected at its front end to said moveable frame adjacent the rear end of said padded bench, means carried by said moveable frame for supporting said padded seat portion in a position where it is in alignment with said padded bench and thus constitutes a substantial continuation of said bench, and means for selectively retaining said seat portion in a position where it is angularly inclined relative to said padded bench.

4. The bench of claim 1 wherein each of said legs is attached to one flap of a hinge, the other flaps of said hinges for each leg overlapping, and common fastening means cooperating with each of said other flaps and the rear end of said moveable frame for rigidly fixing all of said other flaps to said moveable frame.

5. The bench of claim 4 including a padded seat portion pivotally connected at its front end to said moveable frame adjacent the rear end of said padded bench part, said seat portion being moveable from a flat position in alignment with said padded bench to an inclined position relative to said bench, and means for retaining said seat portion in its inclinded position comprising a hinge having one flap carrying an angularly related flange rigidly connected thereto and the other flap rigidly connected adjacent the rear end of said moveable frame, said one flap being moveable from a position clear of said seat portion to a position wherein said flange is engaged by said seat portion to retain it in an elevated inclined position relative to said padded bench after said seat portion has been manually moved to said inclined positioned.

6. The bench of claim 5 wherein said common fastening means also cooperates with said other flap of said last mentioned hinge.

7. The bench of claim 1 including two pairs of laterally spaced, angularly related arms rigidly connected together at one end, means pivotally mounting said one end of said arms to said verticle frame beyond the front ends of the padded bench and said moveable frame so that one pair of arms extends generally downwardly and the other pair of arms extends generally forwardly relative to the vertical frame, padded leg extension roller carried by the opposite ends of each of said pairs of arms, the padded roller carried by the forwardly extending arms including manually releasable locking means connecting said roller to said arms and constructed and arranged to enable said roller to be moved clear of the space between said forwardly extending arms upon release of said locking means.

8. The bench of claim 7 wherein the last mentioned padded roller includes rod means having end parts extending axially from the opposite ends of said roller, hinge means connecting one of the rod ends to one of the forwardly extending arms, a connecting pin cooperating with aligned openings in a part of the other of said arms and the other of said rod ends, and a quick-release cotter pin for retaining said connecting pin within said openings, said roller being swingable about said hinge means to a position clear of the space between said forwardly extending arms upon manual release of said cotter and connecting pins.

9. The bench of claim 7 including forwardly and rearwardly extending bar bell supports on said vertical frame spaced above said padded bench in positions for grasping a bar bell by an exerciser undertaking deep knee bends or bench presses, respectively.

10. The bench of claim 1 including a sleeve releasably and axially engaging the upper end of said vertical frame, forwardly extending body dip handles rigidly carried by said sleeves, and means carried by said sleeves for rigidly releasably clamping said sleeves to the upper ends of said vertical frame.

11. A multi-purpose exercising bench comprising a fixed horizontal ground engaging frame having front and rear ends, a vertical frame rigidly fixed to the front end of said horizontal frame, a second frame having front and rear ends and spaced above said first frame, means fixing the front end of said second frame to said vertical frame, means supporting the rear end of said second frame above the rear end of said first frame, two pairs of laterally spaced, angularly related arms rigidly connected together at one end, means pivotally mounting said one end of said arms to said vertical frame beyond the front end of the second frame so that one pair of arms extends generally downwardly and the other pair of arms extends generally forwardly relative to the vertical frame, a padded leg extension roller carried by the opposite ends of each of said pairs of arms, the paded roller carried by the forwardly extending arms including manually releasable locking means connecting said roller to said arms and constructed and arranged to enable said roller to be moved clear of the space between said forwardly extending arms upon release of said locking means.

* * * * *